US006533876B1

(12) United States Patent
Cornelissen et al.

(10) Patent No.: US 6,533,876 B1
(45) **Date of Patent: *Mar. 18, 2003**

(54) PROCESS AND DEVICE FOR PRODUCING A STEEL STRIP OR SHEET

(75) Inventors: Marcus Cornelis Maria Cornelissen, Castricum (NL); Aldricus Maria Groot, Heerhugowaard (NL); Huibert Willem Den Hartog, Noordwijkerhout (NL)

(73) Assignee: Corus Staal, IJmuiden (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/331,211

(22) PCT Filed: Dec. 19, 1997

(86) PCT No.: PCT/NL97/00718

§ 371 (c)(1),
(2), (4) Date: Sep. 3, 1999

(87) PCT Pub. No.: WO98/26882

PCT Pub. Date: Jun. 25, 1998

(30) Foreign Application Priority Data

Dec. 19, 1996 (NL) ..... 1004829

(51) Int. Cl.[7] ..... C12D 8/04

(52) U.S. Cl. ..... 148/541; 148/602; 148/603; 148/657; 148/658

(58) Field of Search ..... 148/541, 602, 148/603, 657, 658

(56) References Cited

U.S. PATENT DOCUMENTS

| | | | | |
|---|---|---|---|---|
| 4,885,041 A | | 12/1989 | Den Hartog | |
| 5,303,766 A | | 4/1994 | Kreijger et al. | |
| 5,582,658 A | * | 12/1996 | Masui et al. | 148/518 |
| 5,611,232 A | | 3/1997 | Rohde et al. | |

(List continued on next page.)

FOREIGN PATENT DOCUMENTS

| | | |
|---|---|---|
| DE | 19520832 | 4/1996 |
| DE | 19538341 | 3/1997 |
| DE | 19540978 | 5/1997 |

(List continued on next page.)

OTHER PUBLICATIONS

G. McManus, "Ferritic rolling of hot rolled sheet: Successful use of new technology could open doors" Iron & Steel Engineer, vol. 72, No. 8, Aug. 1995, pp. 53–54.

P. Messien et al, "Le Laminage a Froid et le Recuit Des Bandes a Chaud Ferritiques" Cahiers D'Informations Techniques de la Revue de Metallurgie, vol. 89, No. 5, May 1992, pp. 447–453.

*Primary Examiner*—George Wyszomierski
*Assistant Examiner*—Janelle Combs Morillo
(74) *Attorney, Agent, or Firm*—Stevens, Davis, Miller & Mosher, LLP

(57) ABSTRACT

Process for producing a steel strip or sheet, in which liquid steel is cast in a continuous-casting machine to form a thin plate and, while making use of the casting heat, is fed through a furnace device, is roughed in a roughing stand to a pass-over thickness and is rerolled in a finishing rolling stand to form a steel strip or sheet of the desired final thickness, in which (a) to produce a ferritically rolled steel strip, the strip, the plate or a part thereof is fed without interruption at least from the furnace device, at speeds which essentially correspond to the speed of entry into the roughing stand and the following reductions in thickness, from the roughing stand to a processing device which is disposed downstream of the finishing rolling stand, the strip coming out of the roughing stand being cooled to a temperature at which the steel has an essentially ferritic structure; (b) to produce an austenitically rolled steel strip, the strip coming out of the roughing roll is brought to or held at a temperature in the austenitic range, and in the finishing rolling stand it is rolled to the final thickness essentially in the austenitic field and is then cooled, after this rolling, to the ferritic field.

25 Claims, 1 Drawing Sheet

U.S. PATENT DOCUMENTS

| | | | | | |
|---|---|---|---|---|---|
| 5,634,257 | A | * | 6/1997 | Kajiwara et al. | 29/527.7 |
| 5,634,513 | A | | 6/1997 | Ishiguro | |
| 5,743,125 | A | * | 4/1998 | Kneppe et al. | 72/201 |
| 5,759,306 | A | * | 6/1998 | Tosaka et al. | 148/603 |
| 5,802,902 | A | * | 9/1998 | Rosenthal et al. | 72/201 |
| 5,832,985 | A | * | 11/1998 | Pleschiutschnigg et al. | 164/4.76 |
| 6,053,996 | A | * | 4/2000 | Pronk et al. | 148/541 |
| 6,109,336 | A | * | 8/2000 | Pronk et al. | 164/476 |
| 6,280,542 | B1 | * | 8/2001 | Cornelissen et al. | 148/541 |

FOREIGN PATENT DOCUMENTS

| | | | |
|---|---|---|---|
| EP | 0226446 | | 6/1987 |
| EP | 0306076 | | 8/1988 |
| EP | 0306076 | | 3/1989 |
| EP | 0761326 | | 3/1997 |
| EP | 0771596 | | 5/1997 |
| JP | 57-145934 | * | 9/1982 |
| JP | 58122107 | | 7/1983 |
| JP | 61204332 | | 9/1986 |
| JP | 62254954 | | 6/1987 |
| JP | 6471505 | | 3/1989 |
| JP | 01099719 | | 4/1989 |
| JP | 01254302 | | 10/1989 |
| JP | 364202 | | 10/1991 |
| JP | 4046601 | | 2/1992 |
| JP | 5104104 | | 4/1993 |
| JP | 06320202 | | 11/1994 |
| JP | 7214135 | | 8/1995 |
| JP | 07308701 | | 11/1995 |
| JP | 9122709 | | 5/1997 |
| JP | 9164404 | | 6/1997 |
| JP | 09327702 | | 12/1997 |
| WO | 9612573 | | 5/1996 |
| WO | 9746332 | | 12/1997 |

* cited by examiner

PROCESS AND DEVICE FOR PRODUCING A STEEL STRIP OR SHEET

The invention relates to a process for producing a steel strip or sheet, in which liquid steel is cast in a continuous-casting machine to form a thin plate and, while making use of the casting heat, is fed through a furnace device, is roughed in a roughing stand to a pass-over thickness and is rerolled in a finishing rolling stand to form a steel strip or sheet of the desired final thickness, and to a device which is suitable for use in such a process.

Where the following text refers to a steel strip, this is also to be understood as including a steel sheet. A thin plate is understood to mean a plate whose thickness is less than 150 mm, preferably less than 100 mm.

A process of this kind is known from European Patent Application 0 666 122.

This Patent Application describes a process in which a continuously cast thin steel plate, after being homogenized in a tunnel furnace device, is rolled in a number of hot-rolling steps, i.e. in the austenitic field, to form a strip having a thickness of less than 2 mm.

In order to achieve such a final thickness using rolling devices and rolling trains which can be realized in practice, it is proposed to reheat the steel strip, preferably by means of an induction furnace, at least after the first rolling mill stand.

A separating device is positioned between the continuous-casting machine and the tunnel furnace device, which device is used to cut the continuously cast thin plate into pieces of approximately equal length, which pieces are homogenized in the tunnel furnace device at a temperature of approx. 1050° C. to approx. 1150° C. After leaving the tunnel furnace device, the pieces may if desired be cut again into half-plates which have a weight which corresponds to the coil weight of the wound coil to which the steel strip is wound downstream of the rolling device.

The object of the invention is to provide a process of the known type which offers more options and with which, moreover, steel strip or sheet can be produced in a more efficient way. To this end, the process according to the invention is characterized in that a. to produce a ferritically rolled steel strip, the strip, the plate or a part thereof is fed without interruption at least from the furnace device, at speeds which essentially correspond to the speed of entry into the roughing stand and the following reductions in thickness, from the roughing stand to a processing device which is disposed downstream of the finishing rolling stand, the strip coming out of the roughing stand being cooled to a temperature at which the steel has an essentially ferritic structure;

b. to produce an austenitically rolled steel strip, the strip coming out of the roughing roll is brought to or held at a temperature in the austenitic range, and in the finishing rolling stand it is rolled to the final thickness essentially in the austenitic field and is then cooled, after this rolling, to the ferritic field.

In this context, strip is understood to mean a plate of reduced thickness.

In the conventional method for producing ferritic, or cold-rolled, steel strip, the starting point is a hot-rolled roll of steel, as is also produced using the known method from EP 0,666,112. A hot-rolled roll of steel of this kind usually has a weight of between 16 and 30 tonnes. In this case, the problem arises that it is very difficult, with large width/thickness ratios of the steel strip obtained, to control the dimensions of the strip, i.e. the thickness profile over the width of the strip and over the length of the strip. Owing to the discontinuity in the stream of material, the top and tail of the hot-rolled strip behave differently from the central part in the rolling device. Controlling the dimensions represents a problem above all during entry and exit of the hot-rolled strip into and out of the finishing rolling stand for ferritic or cold rolling. In practice, advanced forwards and self-adapting control systems and numerical models have been used in an attempt to keep the top and tail, which have incorrect dimensions, as short as possible. Nevertheless, every roll has a top and tail which is to be rejected and may amount to up to a few tens of meters in length.

In the installations currently used, a width/thickness ratio of about 1200–1400 is regarded as the maximum which can be achieved in practice: a grater width/thickness ratio leads to an excessively long top and tail before reaching a stable situation, and hence to excessive levels of scrap.

On the other hand, with a view to efficiency of materials when working a hot-rolled or cold-rolled steel strip, there is a need for a greater width with an identical or reduced thickness. Width/thickness ratios of 2000 or more are desired in the market, but cannot be achieved in practice with the known process, for the reasons described above.

The process according to the invention makes it possible to rough the steel strip, at any rate from the furnace device, in an uninterrupted or continuous process in the austenitic field, to cool it to the ferritic field and to roll it in the ferritic field to give the final thickness.

A much simpler feedback control has proven sufficient for controlling the dimensions of the strip.

The invention also makes use of the insight that it is possible to employ the process with which, according to the prior art, only hot-rolled steel strip is produced, in such a manner, while making use of essentially the same means, that this process can also be used to obtain, in addition to an austenitically rolled steel strip, a ferritically rolled steel strip as well, having the properties of a cold-rolled steel strip.

This opens up the possibility of using a device which is known per se to produce a wider range of steel strips, and more particularly to produce steel strips which have a considerably higher added value on the market. In addition, the process yields a particular advantage when rolling a ferritic strip according to step a, as will be explained in the following text.

The invention also makes it possible to achieve a number of other important advantages, as will be described in the following text.

When carrying out the process according to the invention, it is preferred for the roughing to take place in the austenitic field, as soon as possible downstream of the furnace device in which the plate is homogenized at temperature. Furthermore, it is preferred to select a high rolling speed and reduction. In order to obtain constant properties for the steel, it is necessary to prevent the plate, or at least an excessive part thereof, from passing into the two-phase field in which the austenitic and ferritic structures exist next to one another. After leaving the furnace device, the homogenized austenitic plate cools most rapidly at the side edges. It has been found that cooling takes place primarily over an edge part of the plate which has a width which is comparable to the current thickness of the plate or strip. By rolling the strip shortly after it leaves the furnace, and preferably with a considerable reduction, the extent of the cooled edge part is limited. It is then possible to produce a strip of the correct strip shape and with constant, predictable properties over virtually the entire width.

The virtually homogeneous temperature distribution over the width, together with the thickness of the plate, provides the additional advantage of a broader working range within which the invention can be employed. Since it is undesirable to carry out rolling in the two-phase field, the working range with regard to the temperature is limited on the underside by the temperature of that part of the plate which first passes into the two-phase field, i.e. the edge region. In the conventional process, the temperatures of the central part is then still fat above the transition temperature at which austenite begins to change into ferrite. In order nevertheless to be able to exploit the higher temperature of the central part, it is proposed in the prior art to reheat the edges. Using the invention, this measure is not necessary, or at least is necessary to a considerably reduced extent, and the result is that the austenitic rolling process can be continued until virtually the entire plate, in particular in the width direction, is at a temperature close to the transition temperature.

The more uniform temperature distribution prevents the situation where a relatively small part of the plate has already passed into the two-phase field, thus making further rolling undesirable, while a large part is still well in the austenitic field and thus could still be rolled. It should also be considered here that on cooling from the austenitic field over a relatively small temperature span of the temperature range within which transformation occurs, a large proportion of the material is transformed. This means that even a small fall below the transition temperature results in a large part of the steel being transformed. For this reason, in practice there is considerable anxiety about falling below the highest temperature of this temperature range.

More detailed embodiments of the invention and a device for carrying out the invention, as well as exemplary embodiments, are described in Patent Application NL-1003293, which is hereby deemed to be incorporated in its entirety in this patent.

The invention is particularly suitable for use in the production of deep-drawing steel. In order to be suitable as a deep-drawing steel, a steel grade has to satisfy a number of requirements, of which a few important ones are discussed below.

To obtain a closed so-called two-part can, the first part of which comprises the base and the body and the second part of which is the lid, the basis for the first part is a planar blank made of deep-drawing steel, which is first deep-drawn to form a cup having a diameter of, for example, 90 mm and a height of, for example, 30 mm, the walls of which cup are then drawn to form the can having a diameter of, for example, 66 mm and a height of, for example, 115 mm. Indicative values for the thickness of the steel material in the various production phases are: initial thickness of the blank 0.26 mm, base thickness and wall thickness of the cup 0.26 mm, base thickness of the can 0.26 mm, wall thickness of the can half-way up 0.09 mm, thickness of the top edge of the can 0.15 mm.

Deep-drawing steel has to be extremely ductile and remain so over the course of time, i.e. it must not age. Ageing leads to high deformation forces, crack formation during the deformation and surface defects owing to flow lines. One way of counteracting the ageing is the so-called overageing by precipitation of carbon.

The desire to save material by being able to make ever lighter cans also has an effect on the requirement of high ductility in order, starting from a given initial thickness of the blank, to be able to achieve a minimum possible final thickness of the can wall and also of the top edge of the can. The top edge of the can places particular demands on the deep-drawing steel. After forming the can by drawing the walls, the diameter of the top edge is reduced, by the process known as necking, in order to be able to use a smaller lid, thus saving on lid material. After the necking, a flange is provided along the top of the top edge in order to be able to attach the lid. The necking and the provision of the flange, in particular, are processes which place high demands on the additional ductility of the deep-drawing steel, which had previously already been deformed during the fabrication of the body.

In addition to the ductility, the purity of the steel is important. Purity is in this case understood to mean the extent to which inclusions, mostly oxidic or gaseous inclusions, are absent. Inclusions of this kind are formed when making steel in an oxygen steel-making plant and from the casting powder which is used in the continuous casting of the steel plate which forms the starting material for the deep-drawing steel. During necking or forming of the flange, an inclusion may lead to a crack, which itself is in turn the cause of a subsequent leak in the can which has been filled with its contents an then closed. During storage and transportation, contents leaking out of the can may, as a result of contamination in particular, cause damage to other cans and goods around it which amounts to many times the value of just the leaking can with its contents. As the thickness of the edge of the can decreases, the risk of a crack resulting from an inclusion increases. Therefore, deep-drawing steel should be free of inclusions. Insofar as inclusions are inevitable in the current method of steel making, their dimensions are to be kept as small as possible, and they should only occur in very small numbers.

Yet a further requirement relates to the level of anisotropy of the deep-drawing steel. When producing a deep-drawn/wall-drawn or wall-thinned two-part can, the top edge of the can does not run in a planar surface, but rather has a wave pattern around the circumference of the can. In specialist circles, the wave crests are referred to as ears. The tendency to earing is a result of anisotropy in the deep-drawing steel. The ears have to be cut down to the level of the lowest trough, in order to obtain a top edge which runs in a flat surface and can be deformed into a flange, and this process leads to a loss of material. The level of earing is dependent on the total cold-rolling reduction and on the carbon concentration.

It is usual, for considerations of process engineering, to start from a hot-rolled sheet or strip having a thickness of 1.8 mm or more. With a reduction of about 85%, this leads to a final thickness of approx. 0.27 mm. In view of the desire to minimize the consumption of material for each can, a lower final thickness, preferably of lower than 0.21 mm, is desired. Guideline values of approx. 0.17 mm are already being mentioned. At a given starting thickness of approx. 1.8 mm, this therefore requires a reduction of more than 90%. With the usual carbon concentrations, this leads to severe earing, and thus, as a result of these ears being cut off, to additional loss of material, thus negating part of the benefit gained from a lower thickness. A solution has been sought in the use of extra-low or ultra-low carbon steel (ULC steel). Steel of this kind, which has generally accepted carbon concentrations of below 0.01%, down to values of 0.001% or lower, is made by blowing more oxygen into the steel melt in an oxygen steel-making plant, so that more carbon is burnt. If desired, this may be followed by a vacuum pan treatment, in order to reduce the carbon concentration further. As a result of introducing more oxygen into the steel melt, this also results in undesirable metal oxides in the steel melt, which remain as inclusions in the cast steel plate, and later in the cold-rolled strip. The effect of inclusions is magnified by the lower final thickness of the cold-rolled steel. As has been discussed, inclusions are damaging, since they can lead to crack formation. As a result of the lower final thickness, this damaging effect applies a fortiori to ULC steel. The result is that the yield of ULC steel grades for packaging purposes is low, owing to the high level of scrap.

Another object of the invention is to provide a process for producing a deep-drawing steel from steel grades of the low-carbon steel class, which is usually understood to mean a carbon content of between 0.1% and 0.01%, making it possible to achieve a low final thickness with a high yield of the material and also allowing other advantages to be achieved. According to the invention, this method is characterized in that the steel strip is a low-carbon steel having a carbon content of between 0.1% and 0.01% and is cooled, at a pass-over thickness of less than 1.8 mm, from the austenitic field to the ferritic field, and the total reduction by rolling in the ferritic field is less than 90%. The level of anisotropy is dependent on the carbon concentration and the total rolling reduction to which the deep-drawing steel has been subjected in the ferritic field.

The invention is based on the further insight that the total reduction in the ferritic field after transition from the austenitic field is important for the earing, and that earing can be prevented or limited, when cold-rolling in the ferritic field, by keeping the reduction within a defined limit, for a given carbon content, by entering the ferritic field with a sufficiently thin strip.

A preferred embodiment of the process according to the invention is characterized in that the total reduction brought about by rolling in the ferritic field is less than 87%. The level of rolling reduction at which minimum anisotropy occurs is dependent on the carbon concentration and increases as the carbon concentration falls. For low-carbon steel, the cold-rolling reduction which produces minimum anisotropy and hence minimum earing, lies in the range of less than 87%, or more preferably less than 85%. In conjunction with good deformation properties, it is preferred for the total reduction to be more than 75%, and more preferably more than 80%.

The reduction to be carried out in the ferritic field can be kept low, at a low end thickness, in another embodiment of the invention which is characterized in that the pass-over thickness is less than 1.5 mm.

The process indicated provides a deep-drawing steel which can be produced in the known manner using a generally known device and which makes it possible to produce thinner deep-drawing steel than was hitherto possible. Known techniques can be used for rolling and further processing in the ferritic field.

The invention will now be explained in more detail with reference to a non-limiting embodiment in accordance with the drawing, in which.

Figure 1:
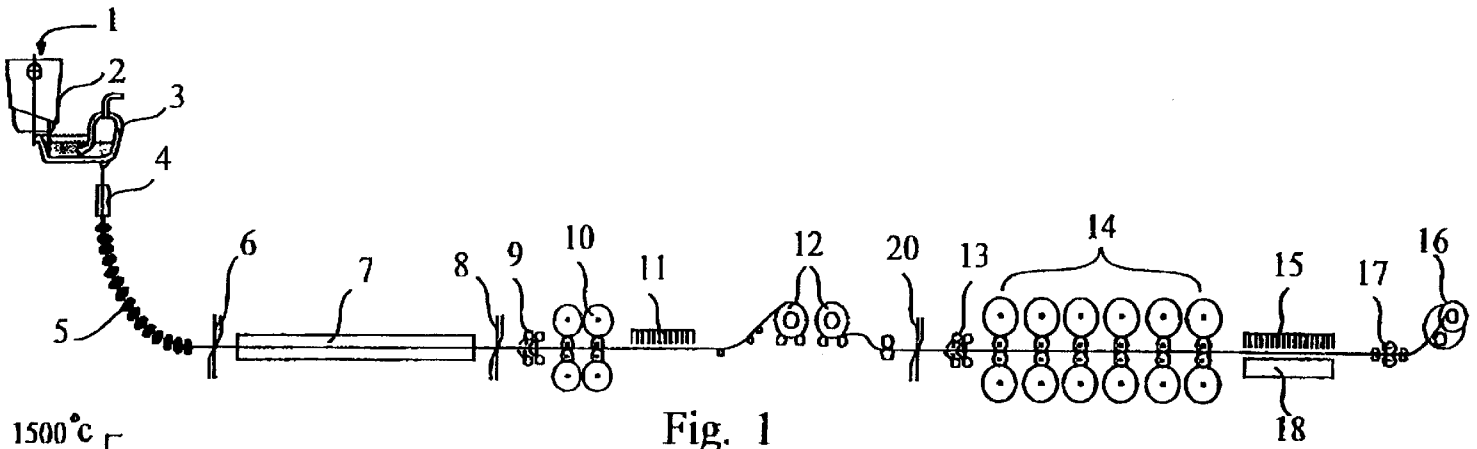
FIG. 1 shows a diagrammatic side view of a device according to the invention.

In FIG. 1, reference numeral 1 indicates a continuous-casting machine for casting thin plates. In this introductory description, a continuous-casting machine is understood to be suitable for casting thin steel plates having a thickness of less than 150 mm, preferably less than 100 mm. Reference numeral 2 indicates a casting ladle, from which the liquid steel to be cast is fed into a transfer ladle 3, which in this design takes the form of a vacuum transfer ladle. Beneath the transfer ladle 3, there is a casting mould 4, into which the liquid steel is poured, where it solidifies at least partially. If desired, the casting mould 4 may be equipped with an electromagnetic brake. The vacuum transfer ladle and the electromagnetic brake are not necessary, and may also each be used on their own, providing the possibility of achieving a higher casting rate and better internal quality of the cast steel. The conventional continuous-casting machine has a casting rate of approximately 6 m/min; extra measures, such as a vacuum transfer ladle and/or an electromagnetic brake, provide the prospect of casting rates of 8 m/min or more. The solidified thin plate is introduced into a tunnel furnace 7 having a length of, for example, 200 m. As soon as the cast plate has reached the end of the furnace 7, the shearing mechanism 6 is used to cut the plate into plate parts. Each plate part represents a quantity of steel corresponding to five to six conventional coils. There is room in the furnace to store a number of plate parts of this kind, for example to store three such plate parts. As a result, those parts of the installation which lie downstream of the furnace can continue to operate while the casting ladle in the continuous-casting machine has to be exchanged and it is necessary to start casting a new plate. Also, storage in the furnace increases the residence time of the plate parts therein, thus also ensuring better temperature homogenization of the plate parts. The speed at which the plate enters the furnace corresponds to the casting rate, and is therefore about 0.1 m/sec. Downstream of furnace 7, there is an oxide-removal device 9, which in this case is in the form of high-pressure water jets, in order to blast the oxide which has formed on the surface of the plate off the surface. The speed at which the plate passes through the oxide-removal installation and enters the furnace device 10 is approximately 0.15 m/sec. The rolling device 10, which performs the function of the roughing device, comprises two four-high stands. If desired, a shearing mechanism 8 may be incorporated for emergencies.

Figure 2:
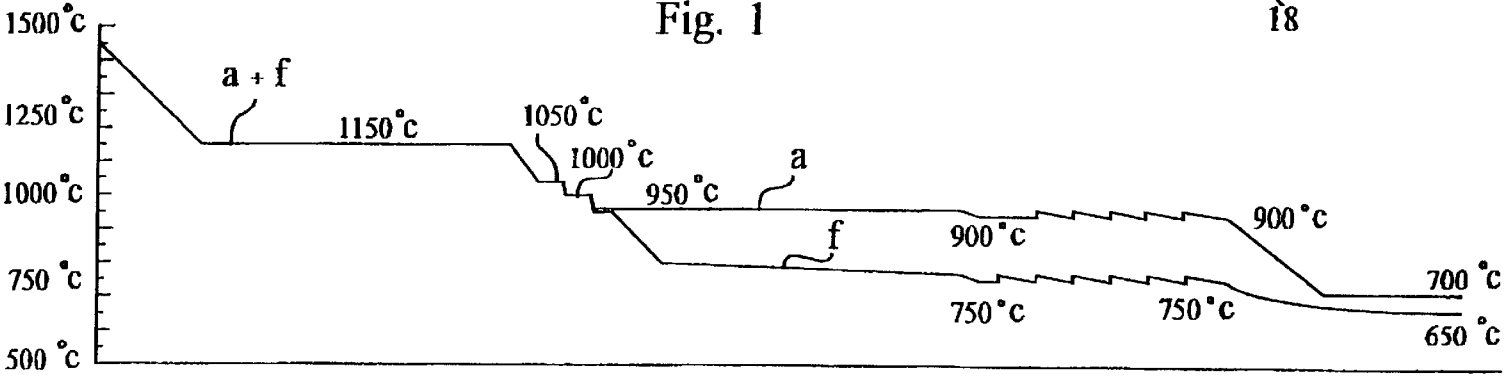
FIG. 2 shows a graph illustrating the temperature curve in the steel as a function of the position in the device.
Figure 3:
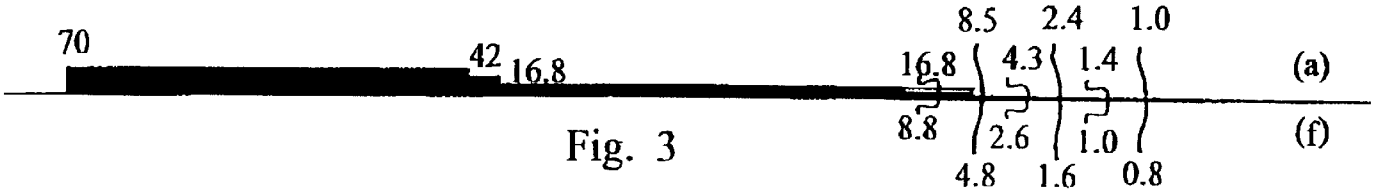
FIG. 3 shows a graph illustrating the thickness profile of the steel as a function of the position in the device.

It can be seen from FIG. 2 that the temperature of the steel plate, which is at a level of approximately 1450° C. on leaving the transfer ladle, falls, over the roller conveyor, to a level of approximately 1150° C., and is homogenized at this temperature in the furnace device. As a result of the intensive spraying with water in the oxide-removal device 9, the temperature of the plate falls from approximately 1150° C. to approximately 1050° C., both for the austenitic process and for the ferritic process, respectively denoted a and f. In the two rolling stands of the roughing device 10, the temperature of the plate falls approximately a further 50° C. on each roll path, so that the plate, which originally had a thickness of approximately 70 mm, has been formed in two steps, with an interim thickness of 42 mm, into a steel strip with a thickness of approximately 16.8 mm at a temperature of approximately 950° C. The thickness profile as a function of the location is shown in FIG. 3. The numbers indicate the thickness in mm. A cooling device 11 and a set of coil boxes 12 and, if desired, an additional furnace device (not shown) are incorporated downstream of the roughing device 10. When producing an austentically rolled trip, the strip coming out of the rolling device 10 is, if appropriate, stored temporarily and is homogenized in the coil boxes 12, and if an extra temperature increase is required it is heated in the heating device (not shown) which is positioned downstream of the coil box. It will be obvious to the person skilled in the art that cooling device 11, coil boxes 12 and the furnace device (not shown) may be in different positions with respect to one another from those outlined above. As a result of the reduction in thickness, the rolled strip enters the coil boxes at a speed of approximately 0.6 m/sec. A second oxide-removal installation 13 is positioned downstream of the cooling device 11, coil boxes 12 or furnace device (not shown), in order again to remove an oxide skin which may have formed on the surface of the rolled strip. If desired, another shearing device may also be incorporated, in order to cut off the top and tail from a strip. The strip is then introduced into a rolling train, which may take the form of six series-connected four-high rolling stands. If an austenitic strip is being produced, it is possible to reach the desired final thickness of, for example, 1.0 mm by using only five rolling stands. The thickness reached in this operation for each rolling stand is indicated in the top row of figures in FIG. 3 for the case of a plate thickness of 70 mm. After leaving the rolling train 14, the strip, which is then at a final temperature of approximately 900° C. with a thickness of 1.0 mm, is cooled intensively by means of a cooling device 15 and is wound onto a coiler 16. The speed at which it enters the coiler is approximately 13 m/sec. If a ferritically rolled steel strip is to be produced, the steel strip leaving the roughing device 10 is cooled intensively by means of cooling device 11. The strip then bypasses coil boxes 12 and, if desired, the furnace device (not shown), and oxide is then removed in oxide-removal installation 13. The strip, which has by now reached the ferritic field, is at a temperature of approximately 750° C. As stated above, some of the material may still be austenitic, but depending on the carbon content and the desired final quality, this is acceptable. In order to achieve the desired final thickness for the ferritic strip of approximately 0.7 to 0.8 mm, all six stands of the rolling train 14 are used. As in the situation where an austenitic strip was rolled, when rolling a ferritic strip there is an essentially identical reduction for each rolling stand, with the exception of the reduction by the final rolling stand. This is illustrated in the temperature curve shown in FIG. 2 and the thickness profile shown by the bottom series of numbers in FIG. 3 for the ferritic rolling of the steel strip, as a function of the position. The temperature curve shows that the strip has an exit temperature which is well above the recrystallization temperature. Therefore, to prevent the formation of oxides, it may be desirable to cool the strip, with the aid of cooling device 15, to the desired coiling temperature, in which case recrystallization may still occur. If the exit temperature from rolling train 14 is too low, a furnace device 18, which is disposed downstream of the rolling train, may be used to bring the ferritically rolled strip up to a desired coiling temperature. Cooling device 15 and furnace device 18 may be placed in parallel or in series with one another. It is also possible to replace one device with the other device, depending on whether ferritic or austenitic strip is being produced. As has been mentioned, if a ferritic strip is being produced, rolling is carried out continuously. This means that the strip emerging from the rolling device 14 and optionally cooling device 15 or furnace device 18 has a greater length than that which is usual for forming a single coil, and that plate part of a complete furnace length, or longer, is rolled continuously. In order to cut the strip to the desired length, corresponding to the usual dimensions of a coil, there is a shearing mechanism 17. By suitably selecting the various components of the device and the process steps which they are used to carry out, such as homogenization, rolling, cooling and temporary storage, it has proven possible to operate this device with a single continuous-casting machine, whereas the prior art uses two continuous-casting machines in order for the limited casting rate to be matched to the much higher rolling rates which are generally used. If desired, an additional so-called closed-coiler may be incorporated directly downstream of the rolling train 14, in order to assist with control of the running and temperature of the strip. The device is suitable for strips having a width which lies in the range between 1000 and 1500 mm, with a thickness of an austenitically rolled strip of approximately 1.0 mm and a thickness of a ferritically rolled strip of approximately 0.7 to 0.8 mm. The homogenization time in the furnace device 7 is about 10 minutes for storage of three plates of the same length as the furnace. The coil box is suitable for storing two complete strips in austenitic rolling.

The method and device according to the invention are particularly suitable for making thin austenitic strip, for example having a final thickness of less than 1.2 mm. A strip of this kind is particularly suitable, with regard to earing as a result of anisotropy, for further ferritic reduction for use as packaging steel in, for example, the drinks can industry.

What is claimed is:

1. Process for producing a steel strip, the process comprising:

casting liquid steel in a continuous-casting machine to form a thin plate;

making use of the casting heat while feeding the plate through a furnace device;

roughing the plate in a roughing stand to consecutively reduce the plate's thickness to a pass-over thickness to form a steel strip;

rolling the strip in a finishing rolling stand to consecutively reduce the strip's thickness to a desired final thickness;

wherein consecutive reductions of thickness occur in the roughing stand and finishing rolling stand;

wherein the rolling in the finishing rolling stand is selected from the group consisting of ferritic rolling (a) and austenitic rolling (b), wherein ferritic rolling (a) and austentic rolling (b) respectively include the following:

a. feeding the strip, the plate or a part thereof without interruption or delay, at least due to the furnace device, from the roughing stand to a processing device disposed downstream of the finishing rolling stand, at speeds which essentially correspond to the speed of entry into the roughing stand and to the consecutive reductions of thickness that occur in the roughing stand and finishing rolling stand, cooling the strip coming out of the roughing stand to a temperature at which the steel has an essentially ferritic structure, wherein between the casting machine and the finishing apparatus the steel is cut such that there is no material connection between the steel in the casting machine and the steel rolled in the finishing apparatus;

b. feeding the strip, the plate or a part thereof without interruption or delay, at least due to the furnace device, from the roughing stand to a processing device disposed downstream of the finishing rolling stand, at speeds which essentially correspond to the speed of entry into the roughing stand and to the consecutive reductions of thickness that occur in the roughing stand and finishing rolling stand;

heating or maintaining the temperature of the strip coming out of the roughing stand in the austenitic range, rolling the strip in the finishing rolling stand to the final thickness, essentially in the austenitic range, then cooling to the ferritic range, wherein between the casting machine and the finishing apparatus the steel is cut such that there is no material connection between the steel in the continuous casting machine and the steel rolled in the finishing apparatus;

cutting the ferritically rolled strip of step (a) or austenitically rolled strip of step (b), after reaching the desired finished thickness, to portions of the desired length of respective coils; and coiling the cut portions.

2. Process according to claim 1, wherein step (b) comprises:

reducing the thickness of the austenitically rolled strip to less than 1.8 mm;

cold-rolling the strip to an end thickness in the ferritic range with a total reduction of less than 90%; and wherein the steel strip is produced from a low or ultra-low carbon steel and is suitable as deep-drawing steel.

3. Process according to claim 2, wherein the end thickness is less than 1.5 mm.

4. Process according to claim 2, wherein the end thickness is less than 1.2 mm.

5. Process according to claim 1, wherein the total reduction resulting from rolling in the ferritic range is less than 87%.

6. Process according to claim 5, wherein the end thickness is reached at least partly through ferritic rolling (a).

7. Process according to claim 5, wherein the end thickness is reached at least partly through ferritic rolling (a).

8. Process according to claim 1 wherein the pass-over thickness is less than 20 mm.

9. Process according to claim 1, wherein the width/thickness ratio of the steel strip is greater than 1500.

10. Process of claim 1, comprising producing a plurality of coils of steel strip from one plate.

11. Process of claim 1, comprising producing 5 or 6 coils of steel strip from one plate.

12. Process of claim 1, wherein the process produces coiled ferritically rolled strips and coiled austentically rolled strips and the steel for the coiled ferritically rolled strips and the steel for the austentitically rolled strips pass through the same roughing stand and the same finishing stand.

13. Process of claim 1, wherein the furnace device is an induction furnace.

14. Process of claim 1, wherein the width/thickness ratio of the steel strip is greater than 2000.

15. Process of claim 1, wherein the speed of the rolling an roughing steps is higher than the casting speed.

16. Process of claim 1, wherein the rolling type is ferritic rolling.

17. Process of claim 1, wherein the rolling type is austenitic rolling.

18. Process of claim 1, wherein the furnace device is at least about 200 m long.

19. Process of claim 1, wherein the casting machine, furnace device, roughing stand, finishing rolling stand and downstream processing device are together over 200 m in length.

20. Process of claim 1, wherein as soon as the plate reaches a downstream end of the furnace, a first shearing mechanism upstream of the furnace cuts the plate into a plate part; the entire plate part is roughed as one piece in the roughing stand to form the strip as one piece; and a second shearing mechanism downstream of the finishing rolling stand cuts the strip into a plurality of strip parts, and each strip part is coiled to form respective coils.

21. Process of claim 20, wherein the plate part is coiled as a single piece after roughing in the roughing stand and subsequently uncoiled and undergoes said austenitic rolling (b).

22. Process of claim 1, comprising storing more than one plate in the furnace device.

23. Process of claim 1, wherein a first shearing mechanism upstream of the furnace cuts the plate into a plate part.

24. Process of claim 1, wherein a first shearing mechanism upstream of the furnace cuts the plate into a plate part; the entire plate part is roughed as one piece in the roughing stand to form the strip as one piece.

25. Process of claim 1, wherein a first shearing mechanism upstream of the furnace cuts the plate into a plate part; the entire plate part is roughed as one piece in the roughing stand to form the strip as one piece; and a second shearing mechanism downstream of the finishing rolling stand cuts the strip into a plurality of strip parts, and each strip part is coiled to form respective coils.

* * * * *